US005996681A

United States Patent [19]

Pöhlandt

[11] Patent Number: 5,996,681

[45] Date of Patent: Dec. 7, 1999

[54] METHOD FOR QUALITY CONTROL IN CORE OR SHELL SHOOTERS AND A DEVICE FOR CORE OR SHELL SHOOTING

[75] Inventor: Walter L. Pöhlandt, Brühl, Germany

[73] Assignee: Adolf Hottinger KG, Mannheim, Germany

[21] Appl. No.: 09/043,587

[22] PCT Filed: Sep. 20, 1996

[86] PCT No.: PCT/DE96/01796

§ 371 Date: Mar. 20, 1998

§ 102(e) Date: Mar. 20, 1998

[87] PCT Pub. No.: WO97/10909

PCT Pub. Date: Mar. 27, 1997

[30] Foreign Application Priority Data

Sep. 20, 1995 [DE] Germany ..... 195 34 984

[51] Int. Cl.[6] ..... B22C 9/10; B22C 13/12; B22C 19/04

[52] U.S. Cl. ..... 164/456; 164/150.1; 164/151.2

[58] Field of Search ..... 164/456, 4.1, 150.1, 164/151.2, 186, 200, 201, 202

[56] References Cited

U.S. PATENT DOCUMENTS

| | | | |
|---|---|---|---|
| 4,248,290 | 2/1981 | Hermes . | |
| 4,280,357 | 7/1981 | Savage . | |
| 5,589,650 | 12/1996 | Flemming et al. | 164/456 X |
| 5,711,361 | 1/1998 | Landua et al. | 164/200 X |
| 5,748,322 | 5/1998 | Konder et al. . | |

FOREIGN PATENT DOCUMENTS

| | | | |
|---|---|---|---|
| 31 48 461 | 4/1983 | Germany . | |
| 94 16 307 | 1/1995 | Germany . | |
| 44 34 798 | 5/1995 | Germany . | |
| 2-299765 | 12/1990 | Japan | 164/151.2 |
| 2-299766 | 12/1990 | Japan | 164/151.2 |
| WO 95/09706 | 4/1995 | WIPO . | |

*Primary Examiner*—J. Reed Batten, Jr.
*Attorney, Agent, or Firm*—Alston & Bird LLP

[57] ABSTRACT

A method and apparatus for controlling quality in a foundry having a plurality of core shooting machines which produce individual cores which are assembled to produce multi-part core assemblies which serve as foundry molds. The cores are removed from the shooting machines and at least selected cores are measured in a non-contacting manner. The measured data are then compared with stored desired values which may be determined by an analysis of an acceptable core, and any core having measured data which deviate from the stored desired values is rejected. Thus, the production of defective castings is avoided.

21 Claims, 1 Drawing Sheet

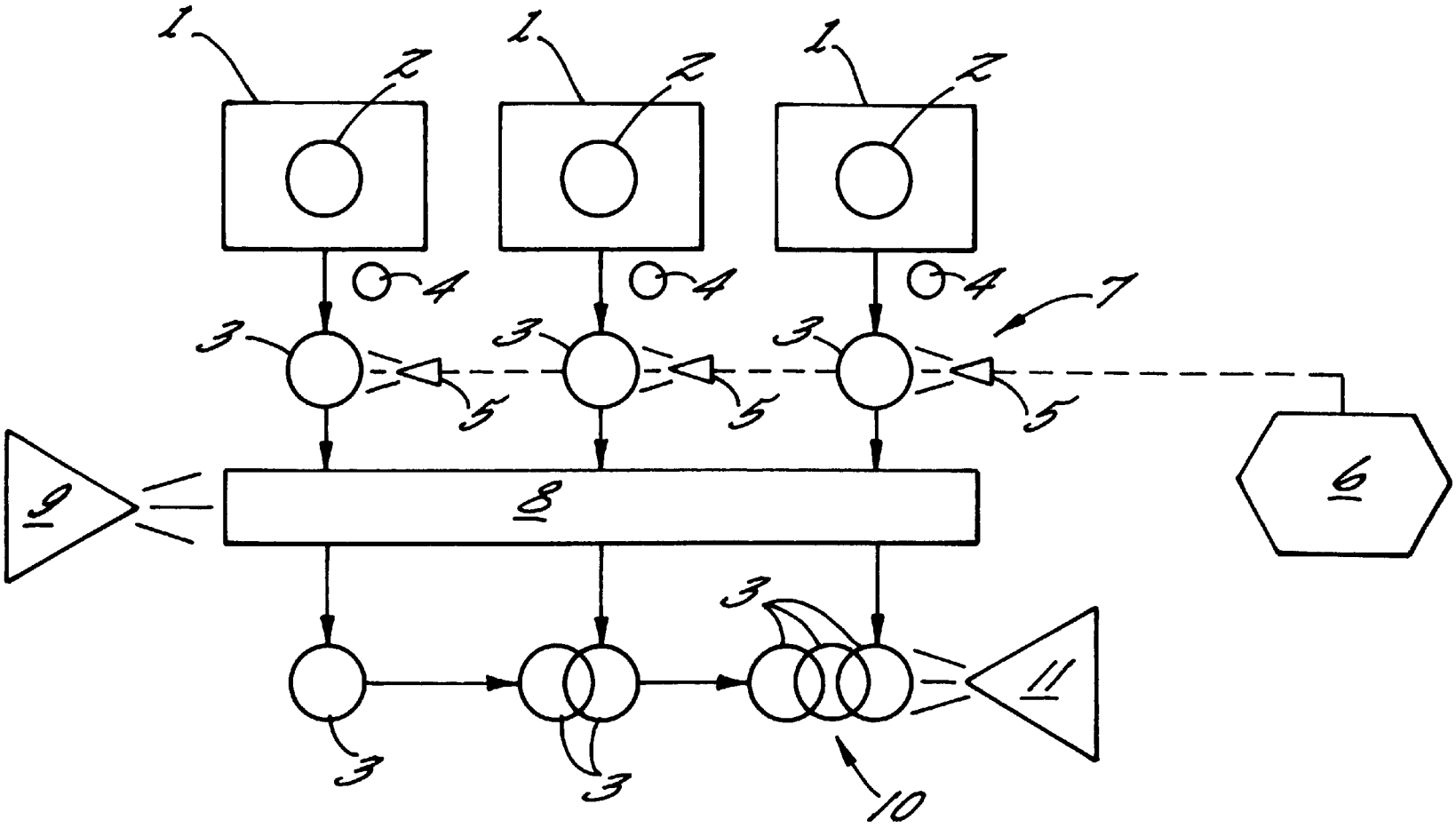
1
2
3
4
5
6
7
8
9
10
11

METHOD FOR QUALITY CONTROL IN CORE OR SHELL SHOOTERS AND A DEVICE FOR CORE OR SHELL SHOOTING

BACKGROUND OF THE INVENTION

The invention relates to a method of controlling the quality in core or shell shooting machines, wherein a molding material is forced by means of a shooting device into an openable tool and solidified therein to form a component of a mold—core, shell, or the like—and wherein the mold component is removed when the tool is open.

Basically the present invention relates to the field of foundry practice. To produce castings, foundry cores or foundry molds are generally made as separate parts, combined, and joined together to form a casting mold or core assembly. Thereafter, these core assemblies are filled with molten metal for producing, for example, a metallic workpiece. In mass production the core assemblies that are to be filled with molten metal pass one after the other through the production line.

In this connection, it is quite especially important that the workpieces cast in the core assemblies require an extremely long cooling phase, which will often last over several hours. Only after this cooling phase, is it possible to inspect the cast workpiece or product. Consequently, it is possible to find only several hours after casting and, thus, likewise several hours after the core shooting operation, whether or not the part cast in the core assembly is entirely free of defects.

In the event that a defective core is used, it will be possible to detect a reject resulting therefrom during the casting only after hours following the production of the core. Should in this instance the defect on the core again be a systematic, recurrent defect, rejects would be produced for hours before the defect is found on the cast product. The defective cores that are accountable for these rejects may originate, on the one hand, from defects in the tool of the core shooting machine and, on the other hand, from damage that occurs while handling, transporting, or assembling the cores. In any event, it is not justifiable to be able to detect defects and, thus, rejects, only after completion of the casting operation, or during an inspection of the cooled castings.

Core and shell shooting machines of the above-described kind have been known from practice for decades. Only by way of example, reference may be made to DE 31 48 461 C1.

DE 44 34 798 A1 discloses likewise a core and shell shooting machine, in which at least one visual inspection of the tool is provided. In the long run, the visual inspection disclosed in DE 44 34 798 A1 is impractical, inasmuch as the tool cannot be constantly observed, in particular within the scope of a fully automatic production. For a visual inspection, a skilled operator would have to observe the tool constantly, i.e., after each shooting operation. Even if such a visual observation or inspection were to go forward, the destiny of an ejected core that is to be further transported would be left open, since—as aforesaid—defects or damage may also occur while handling, transferring, or even assembling the cores.

It is therefore the object of the present invention to provide a method of controlling quality in core or shell shooting machines, wherein it is possible to recognize rejects and to prevent—systematically—repeating rejects. Furthermore, it is an object to provide an apparatus for shooting cores and shells with the use of the method in accordance with the invention.

SUMMARY OF THE INVENTION

The above and other objects and advantages of the present invention are achieved by a method and apparatus which includes a plurality of core shooting machines disposed along a production line, with each core shooting machine comprising an openable tool. A mold component (i.e., core) is formed at each shooting machine by a shooting device which delivers a molding material into the associated tool, and the resulting mold components are then removed from the tools and assembled to form a core assembly.

The method and apparatus of the present invention are further characterized in that the mold component is measured in a noncontacting manner, when the tool is open, and/or during its removal, and/or after its removal, that the measured data are supplied to a computer, if need be, prepared therein, and compared with stored desired values, and the mold component is identified as a reject when a predeterminable or definable deviation from the desired values is detected.

In accordance with the invention, one has departed from the conventional production of mold components, in particular cores and shells, wherein a quality control in the course of the core shooting process was totally nonexistent. Rather, it has been common practice to exchange and clean the tool regularly, or to perform occasionally a superficial, visual inspection of the tool in use. In any event, until now a quality control has not occurred, though the damage arising from rejects can be considerable in the subsequent casting of workpieces.

In accordance with the invention, it has further been recognized that during the casting operation, rejects can be effectively avoided, when the produced mold component is not visually inspected, but is measured instead by applying the latest technique. Such a measuring of the produced core can occur after opening the tool, and/or while removing the mold component, and/or after removing the mold component. The measuring is noncontacting for purposes of avoiding damage to the mold component. The data obtained from the noncontacting measurement are supplied—on line—to a computer, and—depending on needs—they are prepared or processed therein. These possibly prepared and processed data are again compared with stored desired values of the mold component. If a deviation from desired values is found outside of a predeterminable tolerance range, the measured mold component is identified as a reject. In this respect, the computer in use for this purpose serves as a process computer, in that it influences the course of the production to such an extent as to remove—if need be, by manipulators or automatically—the mold component that is identified as a reject. To this extent, it is effectively avoided that a mold component that has been produced or removed from the tool with defects reaches an assembly station or assembly line and constitutes there a cause for a totally defective core assembly.

In an advantageous manner, the desired values of the mold component being monitored with respect to quality are determined on an "accepted part" with the same device as is used for carrying out the quality control. The thereby-obtained data of the measurement are processed in the computer to desired values and stored in a memory that is provided to this end. In subsequent measurements of mold components, the determined data of the measurement are compared with the previously stored desired values. Likewise, however, it would also be possible to input the desired values with reference to predetermined technical data, or to compute the surface profile of the mold components.

When performing the quality control, each produced mold component could be measured, so as to prevent by all means a transfer of a defective mold component. To reduce the control expenditure, in particular to lessen the computing time, and to avoid a negative influence of the quality control on the cycle time, it would be possible to measure only the mold components that are selected via a random generator. Likewise, it would be possible to measure every nth produced mold component, with the parameter n being again predeterminable or adjustable as desired. Since it is known that tools wear off or must be cleaned after a certain service life, the parameter n could be automatically reduced as the service life of the tool increases, so that almost every or even each mold component is measured shortly before a tool change.

Within the scope of the quality control being performed, it would be possible to measure the mold component as a whole, i.e. over its entire surface. This measurement will also allow to cover recesses, undercuts, or the like by suitable detectors. By experience, however, defects occur very predominantly in critical areas, so that it is again possible to reduce the time necessary for the detection or the measurement, in that the mold component is measured only in part, namely in particular in predeterminable critical regions. In this respect, it would be possible to minimize the time required for the measurement by a purposeful detection.

As previously described, defects on the mold components occur not only during the actual shooting of the mold components, during the opening of the tool, or during the removal of the mold components from the tool, but may also occur in the course of further processing up to and including the combination to a core assembly. Consequently, it is particularly advantageous to perform a more extensive monitoring or measuring of the mold components, in particular when the mold component is gripped by a manipulator and moved by same to a transfer or processing station. In this respect, it would be possible to measure the mold component likewise in a noncontacting manner, before, during, or after its delivery to the transfer or processing station. To avoid repetitions the previously described measurement in the region of the core shooting machine is herewith incorporated by reference, inasmuch as also in this instance the same criteria apply or the same measures are to be taken.

After its transfer by the manipulator or directly after the core shooting machine, it would also be possible to advance the mold component directly to a conveyor and to transport same by means of the conveyor along a conveying path to a transfer or processing station. Likewise, in this instance it will be especially advantageous, when the mold component is measured in a noncontacting manner before, while, or after reaching the transfer or processing station and, if need be, after its processing. The foregoing description will also apply in this instance, and the same measures may be taken as during the measuring in the region of the core shooting machine.

In a further operation, it is possible to combine the mold component together with other mold components to form a mold or core assembly. Likewise, in this instance it will be possible to perform an additional measurement of the mold component or the already combined mold components during and/or after each assembly operation. Likewise, this measurement is noncontacting, so that damage to the mold component is effectively prevented.

Similarly to the determination of the desired values for the mold component, it is also possible to determine the desired values for inspecting the tool, in that these desired values are determined on the tool before or after shooting a mold component that is identified as an "accepted part." These values are prepared or processed in a computer and stored in a special memory as desired values. To rate the condition of the tool, each of the determined values is compared with the desired values, thereby facilitating likewise a direct evaluation of the condition of the tool.

In like manner as the mold component, the tool may be measured after removing each produced mold component. Likewise, it would be possible to measure the tool after removal of every nth produced mold component, with the parameter n being predeterminable as desired. As the service life or operating time of the tool increases, the parameter n may be automatically decreased, so that shortly before a predetermined tool change, the tool is inspected or measured after almost each produced mold component.

In the case of detecting a defect on a mold component, the quality control could be devised, or the computer could control the detection device, in such a manner that the tool is measured, preferably before, while, or after removing the mold component from the tool. A measurement of the tool before removing the mold component is possible only to a limit extent. In any event, the detection of a defective mold component is to lead to an immediate inspection of the tool.

In like manner as the mold component, it is possible to measure the tool as a whole. Moreover, for purposes of shortening the detection time, it will be advantageous to associate a defect that is detected on the mold component to the corresponding region on the tool and to examine only this region of the tool, which is possibly accountable for the defect on the mold component. This region may be examined or measured in a purposeful manner, so as to detect even slightest deviations from desired values.

If a defect is detected on the tool, it will be possible in a further advantageous manner to automatically initiate a tool change. After exchanging the defective tool, it would then be necessary to determine, whether or not the defect resulted from contaminations or wear. In this instance, an evaluation by a specialist—off side the actual production process—will barely be avoidable.

The noncontacting measurement of both the mold component and the tools may occur with the use of a great variety of techniques. Thus, for example, it is possible to scan in a noncontacting manner the mold components that consist of molding materials, by means of a sensor arrangement that operates by capacitance. Depending on the material of the mold components, and in particular likewise for a noncontacting measurement of the tools, sensor arrangements operating by inductance or the eddy current principle present themselves in addition to the capacitative sensor arrangement.

Regardless of the materials of the parts—mold components or tools—that are to be measured, the measurement may also occur by means of a sensor arrangement operating with ultrasound or by means of an optical sensor arrangement. The use of an optical sensor arrangement will require an adequate illumination. Especially advantageous within the scope of an optical sensor arrangement is the use of a video camera with a subsequent optical image processing, wherein the grey and/or color shades of video images that are taken of the component being monitored are compared with previously stored grey shades and/or color shades of an "accepted component." In this way, it is possible to conduct a comparison of surface structures and, thus, a quality control.

The apparatus for shooting cores or shells is intended for carrying out the above-described method. This apparatus is characterized by a detection device for a noncontacting measurement of the mold component when the tool is open, and/or during removal of the mold component, and/or after removal of the mold component. Moreover, the apparatus includes a computer for controlling the detection device and for receiving, processing or preparing the measured data, as well as for comparing the processed values of the measurement with desired values of the mold component, which are stored in a memory. The same applies to the measurement of the tool.

For a comprehensive monitoring of the mold components on the one hand and the tools on the other, the detection device comprises detectors not only in the region of the tool of the core shooting machine, but also on subsequent manipulators, conveying devices, transfer and processing stations. Preferably, the detectors are arranged for movement and/or rotation, so as to permit, in the ideal case, a scanning of the surface of the mold component being examined or the tool being monitored.

As previously described with respect to the method of the invention, the detectors may be sensors operating by capacitance, inductance, or the eddy current principle, depending on the quality of the material of the part being monitored. Likewise, it is possible that the detectors are ultrasound sensors. Finally, it is possible to use optical sensors. In this instance, it is advantageous to use video cameras of an image processing unit. To avoid repetitions, the foregoing description is herewith incorporated by reference.

There exist various possibilities of improving and further developing the teaching of the present invention. To this end, reference may be made on the one hand to the claims and on the other hand to the following description of an embodiment of the invention with reference to the drawing. In conjunction with the description of the preferred embodiment of the invention with reference to the drawing, also generally preferred embodiments and further developments of the teaching are described.

BRIEF DESCRIPTION OF THE DRAWING

The single drawing is a block diagram schematically illustrating the arrangement of an apparatus for shooting cores or shells in accordance with the invention with subsequent stations. With reference to the drawing, the method of the present invention is described in more detail.

DETAILED DESCRIPTION OF THE PREFERRED EMBODIMENT

The drawing is a schematic illustration—in the form of a block diagram—of three core shooting machines 1 that are arranged side by side, each core shooting machine comprising a bipartite tool 2. In the core shooting machines 1, different cores 3 are produced, which are combined in a subsequent station to a core assembly. After opening the tools 2, the cores 3 are removed from the actual core shooting machine by manipulators generally indicated at 4, and measured in a noncontacting manner directly after their removal. To this end, CCD cameras 5 are used which supply the recorded image in digitized form to a computer 6. In the computer, the gray or color values of the image taken of the produced core 3 are processed and compared with desired values via image recognition programs commonly used in image processing. In the case of deviations of the measured data from the desired values beyond definable limit values, the core 3 is identified as a reject and removed—again via manipulators.

A schematically illustrated detection device 7 permits monitoring or measuring all mold components or cores 3 as well as tools 2. A selection of cores 3 that are to be detected is possible on the basis of any desired rules. Likewise possible is an only partial measuring of the cores 3 as well as tool 2.

The core shooting machine is followed by a transfer station 8, from which the cores 3 proceed to assembly. Likewise at the transfer station 8, the cores 3 are optically measured, so as to be able to detect damage that occurred during the transportation or during the transfer. At this station, a further detection device 9 is provided with CCD cameras serving as detectors.

The transfer station 8 is followed by manipulators not shown in the drawing, as well as a conveying path which is followed by the combination of individual cores 3 to a core assembly 10. Each individual step of the combining operation is again monitored via a detection device 11, so as to detect there-damaged cores 3 and to remove same via manipulators. In any event, the core assembly 10 is inspected upon completion. For this inspection it is also possible to apply simultaneously several possibilities of detection or several methods of detection. In this respect, it is possible to check, for example, by means of capacitative sensors the wall thicknesses of the core assemblies, or to effectively eliminate sources of defect in a later casting operation.

Finally, it should be expressly emphasized that the above-described embodiment serves only for a better understanding of the claimed teaching, without however limiting same to the merely arbitrarily selected embodiment.

I claim:

1. A method of controlling the quality of individual cores to be used in the fabrication of multi-part core assemblies which serve as foundry molds, and comprising the steps of providing a plurality of core shooting machines disposed along a production line, with each core shooting machine comprising an openable tool, shooting a core in the tool of each of the core shooting machines, removing each of the cores from their associated tools and assembling the removed cores to form a core assembly, measuring at least selected cores in a non-contacting manner and supplying the measured data to a computer which compares the measured data of each measured core with stored desired values, rejecting any core having measured data which deviate from the stored desired values by more than a predetermined amount, and wherein the stored desired values are determined by an analysis of an acceptable core.

2. The method as defined in claim 1 wherein the stored desired values are determined by an analysis of an acceptable core utilizing the same device as is used for carrying out the measuring step.

3. The method as defined in claim 1 wherein the measuring step includes measuring each of the cores.

4. The method as defined in claim 1 wherein the measuring step includes measuring only the cores that are selected by a random generator.

5. The method as defined in claim 1 wherein the measuring step includes measuring each nth produced core, with n being predetermined.

6. The method as defined in claim 1 wherein the measuring step includes measuring each core as a whole.

7. The method as defined in claim 1 wherein the measuring step includes measuring at least one predetermined critical region of each core.

8. The method as defined in claim 1 wherein the removing step includes engaging each core with a manipulator and transporting the engaged core to a transfer or processing station, and wherein the measuring step includes measuring each core in a non-contacting manner before, during, or after its having been transported to the transfer or processing station.

9. The method as defined in claim 1 wherein upon rejecting any core, the associated tool is directly measured to detect any defect therein.

10. The method as defined in claim 9 wherein the step of directly measuring the associated tool comprises measuring the tool as a whole.

11. The method as defined in claim 9 wherein the step of directly measuring the associated tool comprises measuring only that portion of the tool which is associated with the detected defect of the core.

12. The method as defined in claim 9 wherein upon detecting a defect in any tool, exchanging a new tool for the defective tool.

13. The method as defined in claim 1 wherein the measuring step includes measuring the selected cores utilizing a sensor arrangement which operates by capacitance, or induction, or the eddy current principle.

14. The method as defined in claim 1 wherein the measuring step comprises utilizing ultrasound.

15. The method as defined in claim 1 wherein the measuring step comprises utilizing an optical sensor.

16. The method as defined in claim 1 wherein the measuring step comprises utilizing a video camera with an image processing unit.

17. An apparatus for controlling the quality of individual cores to be used in the fabrication of multi-part core assemblies which serve as foundry molds, and comprising a plurality of core shooting machines disposed along a production line, with each core shooting machine comprising an openable tool and a shooting device for delivering a molding material into the associated tool, a plurality of manipulators for removing each of the cores from their associated core shooting machines and assembling the removed cores to form a core assembly, a detection device for measuring in a non-contacting manner at least selected cores from the tool at each core shooting machine and supplying the measured data to a computer which compares the measured data of each measured core with stored desired values, and whereby any core having measured data which deviates from the stored desired values by more than a predetermined amount may be rejected.

18. The apparatus as defined in claim 17 wherein the detection device is configured for measuring an acceptable core in a non-contacting manner and determining the stored desired values which are stored in the computer.

19. The apparatus as defined in claim 17 wherein each detection device comprises a sensor operated by capacitance, or inductance, or the eddy current principle.

20. The apparatus as defined in claim 17 wherein each detection device comprises an optical sensor.

21. The apparatus as defined in claim 17 wherein each detection device comprises a video camera with an image processing unit.

* * * * *